US005682855A

United States Patent [19]

Lee et al.

[11] Patent Number: 5,682,855

[45] Date of Patent: Nov. 4, 1997

[54] METHOD FOR CONTROLLING RPM OF ENGINE IN HYDRAULIC CONSTRUCTION MACHINE

[75] Inventors: Si Cheon Lee; Myung Hoon Song, both of Changwon, Rep. of Korea

[73] Assignee: Samsung Heavy Industries Co., Ltd., Seoul, Rep. of Korea

[21] Appl. No.: 742,302

[22] Filed: Nov. 1, 1996

[30] Foreign Application Priority Data

Oct. 31, 1995 [KR] Rep. of Korea ..... 95-38603

[51] Int. Cl.[6] ..... F02D 41/14

[52] U.S. Cl. ..... 123/352

[58] Field of Search ..... 123/350, 352, 123/357, 361, 339.19

[56] References Cited

U.S. PATENT DOCUMENTS

| | | | |
|---|---|---|---|
| 4,955,344 | 9/1990 | Tatsumi et al. | 123/352 |
| 5,080,062 | 1/1992 | Strenzke | 123/352 |

*Primary Examiner*—Andrew M. Dolinar

*Attorney, Agent, or Firm*—Kenyon & Kenyon

[57] ABSTRACT

A method for controlling the RPM of an engine in a hydraulic construction machine. A reference throttle lever position value and a reference engine RPM value are set to allow the engine to have a target output characteristic. A first control arithmetic operation is performed in response to a present throttle lever position value and the set reference throttle lever position value to allow a difference between the present throttle lever position value and the set reference throttle lever position value to be within the range of a mechanical error of an engine throttle control mechanism. A first control signal is generated as a result of the first control arithmetic operation to control the RPM of the engine. Then, a second control arithmetic operation is performed in response to a present engine RPM value and the set reference engine RPM value to allow the present engine RPM value to be approximated to the set reference engine RPM value under the condition that a difference therebetween is within the range of the mechanical error of the engine throttle control mechanism. A second control signal is generated as a result of the second control arithmetic operation to control the RPM of the engine.

3 Claims, 3 Drawing Sheets

METHOD FOR CONTROLLING RPM OF ENGINE IN HYDRAULIC CONSTRUCTION MACHINE

BACKGROUND OF THE INVENTION

1. Field of the Invention

The present invention relates in general to controlling the RPM (revolutions per minute) of engines in hydraulic construction machines such as an excavator, a loader, a dozer and the like, and more particularly to a method for controlling the RPM of an engine in a hydraulic construction machine, in which the output characteristic of the engine is set to the optimum status when the RPM of the engine is set to a desired value according to working environment and characteristic.

2. Description of the Prior Art

Referring to FIG. 1, there is schematically shown the construction of a conventional engine-pump system for a hydraulic construction machine. As shown in this drawing, the engine-pump system comprises a diesel engine 1 acting as a prime mover, a plurality of variable displacement hydraulic pumps 2 being driven by the diesel engine 1 to convert mechanical energy from the diesel engine 1 into hydraulic energy, and actuators such as a hydraulic cylinder 4 and a hydraulic motor 5 being driven by a pressurized oil from the hydraulic pumps 2 to actuate various working elements 3. A main control valve (MCV) 10 is provided between the hydraulic pumps 2 and the actuators to switch an oil path therebetween to control the actuators. Under the control of the main control valve 10, the actuators can be started or stopped in operation or changed in direction.

In the hydraulic construction machine with the above-mentioned construction, an engine throttle control mechanism 7 is driven by an engine throttle stepping motor 6. As the engine throttle control mechanism 7 is driven, it adjusts an engine throttle lever 8 to increase or reduce the RPM of the diesel engine 1. Engine throttle lever position detection means 11 is provided to detect the position of the engine throttle lever 8. Engine RPM detection means 12 is provided to detect the RPM of the diesel engine 1. A controller 9 is adapted to receive values detected by the engine throttle lever position detection means 11 and engine RPM detection means 12 and an output signal from engine output characteristic set means 13. The controller 9 performs a control arithmetic operation in response to the received values and signal and generates a control voltage as a result of the control arithmetic operation. Then, the controller 9 outputs the generated control voltage to the engine throttle stepping motor 6 to operate the engine 1 at the desired output characteristic state.

FIG. 2 is a view illustrating the relation between the RPM and output characteristic of the engine 1 with respect to a load. The controller 9 performs a control operation to allow the engine 1 to output a reference engine torque Tref at a reference RPM Nref, namely, the engine output to have a set characteristic curve T=f(N). Such an engine RPM reference control method is performed on the basis of the engine RPM as a control reference input. Namely, the engine RPM reference control method is performed to set the engine throttle lever 8 in a position allowing the engine RPM to have the reference value Nref. However, the controlled engine output characteristic may frequently be different from values desired according to loads.

For example, assume that the throttle lever position is changed from T=f(N) to T=g(N) by the engine output characteristic set means 13 due to a variation of the working condition. When the engine RPM is set to a value Nno–load2 at a no-load state, the engine output characteristic can be set to the desired status T=g(N). However, in the case where the engine RPM is set to the value Nno–load2 at a load state, the engine output characteristic is set to a value T=h(N). In FIG. 2, the reference characters B and C designate target points for the engine RPM control and the reference character A designates a target point for the pump control. The target point C is used when an additional load such as an air conditioner is given. In other words, the controlled engine status are different according to a disturbance load.

On the other hand, a conventional engine throttle lever position reference control method is performed on the basis of the engine throttle lever position as a control reference input. Namely, the engine throttle lever position reference control method is performed to set the engine throttle lever 8 in a reference throttle position. However, in such an engine throttle lever position reference control method, although the position control is accurately performed, the actual engine throttle lever position may frequently be different from the reference value due to an error in a link structure of the engine throttle control mechanism 7 which couples the engine throttle lever position detection means 11 with the engine throttle lever 8. For example, in the case where the position of the engine throttle lever 8 is changed from T=f(N) to T=g(N) due to a variation of the working condition, the engine output characteristic must be set to the desired status T=g(N) under the engine throttle lever position control. However, in this case, the engine output characteristic is actually set to an unspecific value near the desired status T=g(N) because of a mechanical error of the engine throttle control mechanism 7.

SUMMARY OF THE INVENTION

Therefore, the present invention has been made in view of the above problems, and it is an object of the present invention to provide a method for controlling the RPM of an engine in a hydraulic construction machine, in which the output characteristic of the engine is controlled according to working environment and characteristic in such a manner that it can be set to the optimum status with no effect of a disturbance load and a mechanical error of an engine throttle control mechanism when the RPM of the engine is set to a desired value.

In accordance with an aspect of the present invention, in a hydraulic construction machine comprising an engine, means for setting an output characteristic of the engine, a motor for driving a throttle lever for the engine, an engine throttle control mechanism for transferring a drive force from the motor to the engine throttle lever, means for detecting a position of the engine throttle lever and control means for controlling RPM of the engine, there is provided a method for controlling the RPM of the engine, comprising the first step of setting a reference throttle lever position value in response to an output signal from the engine output characteristic set means to allow the engine to have a target output characteristic; the second step of performing a control arithmetic operation in response to a present throttle lever position value from the engine throttle lever position detection means and the set reference throttle lever position value to allow a difference between the present throttle lever position value and the set reference throttle lever position value to be within the range of a mechanical error of the engine throttle control mechanism; and the third step of generating a control signal as a result of the control arithmetic operation and outputting the generated control signal to the motor to control the RPM of the engine.

In accordance with another aspect of the present invention, in a hydraulic construction machine comprising an engine, means for setting an output characteristic of the engine, a motor for driving a throttle lever for the engine, an engine throttle control mechanism for transferring a drive force from the motor to the engine throttle lever, means for detecting RPM of the engine and control means for controlling the RPM of the engine, there is provided a method for controlling the RPM of the engine, comprising the first step of setting a reference engine RPM value in response to an output signal from the engine output characteristic set means to allow the engine to have a target output characteristic; the second step of performing a control arithmetic operation in response to a present engine RPM value from the engine RPM detection means and the set reference engine RPM value to allow the present engine RPM value to be approximated to the set reference engine RPM value under the condition that a difference therebetween is within the range of a mechanical error of the engine throttle control mechanism; and the third step of generating a control signal as a result of the control arithmetic operation and outputting the generated control signal to the motor to control the RPM of the engine.

In accordance with yet another aspect of the present invention, in a hydraulic construction machine comprising an engine, means for setting an output characteristic of the engine, a motor for driving a throttle lever for the engine, an engine throttle control mechanism for transferring a drive force from the motor to the engine throttle lever, means for detecting a position of the engine throttle lever, means for detecting RPM of the engine and control means for controlling the RPM of the engine, there is provided a method for controlling the RPM of the engine, comprising the first step of setting a reference throttle lever position value in response to an output signal from the engine output characteristic set means to allow the engine to have a target output characteristic; the second step of performing a first control arithmetic operation in response to a present throttle lever position value from the engine throttle lever position detection means and the set reference throttle lever position value to allow a difference between the present throttle lever position value and the set reference throttle lever position value to be within the range of a mechanical error of the engine throttle control mechanism; the third step of generating a first control signal as a result of the first control arithmetic operation and outputting the generated first control signal to the motor to control the RPM of the engine; the fourth step of setting a reference engine RPM value in response to the output signal from the engine output characteristic set means when the difference between the present throttle lever position value and the set reference throttle lever position value is within the range of the mechanical error of the engine throttle control mechanism; the fifth step of performing a second control arithmetic operation in response to a present engine RPM value from the engine RPM detection means and the set reference engine RPM value to allow the present engine RPM value to be approximated to the set reference engine RPM value under the condition that a difference therebetween is within the range of the mechanical error of the engine throttle control mechanism; and the sixth step of generating a second control signal as a result of the second control arithmetic operation and outputting the generated second control signal to the motor to control the RPM of the engine.

BRIEF DESCRIPTION OF THE DRAWINGS

The above and other objects, features and advantages of the present invention will be more clearly understood from the following detailed description taken in conjunction with the accompanying drawings, in which.

DETAILED DESCRIPTION OF THE PREFERRED EMBODIMENTS

Figure 1:
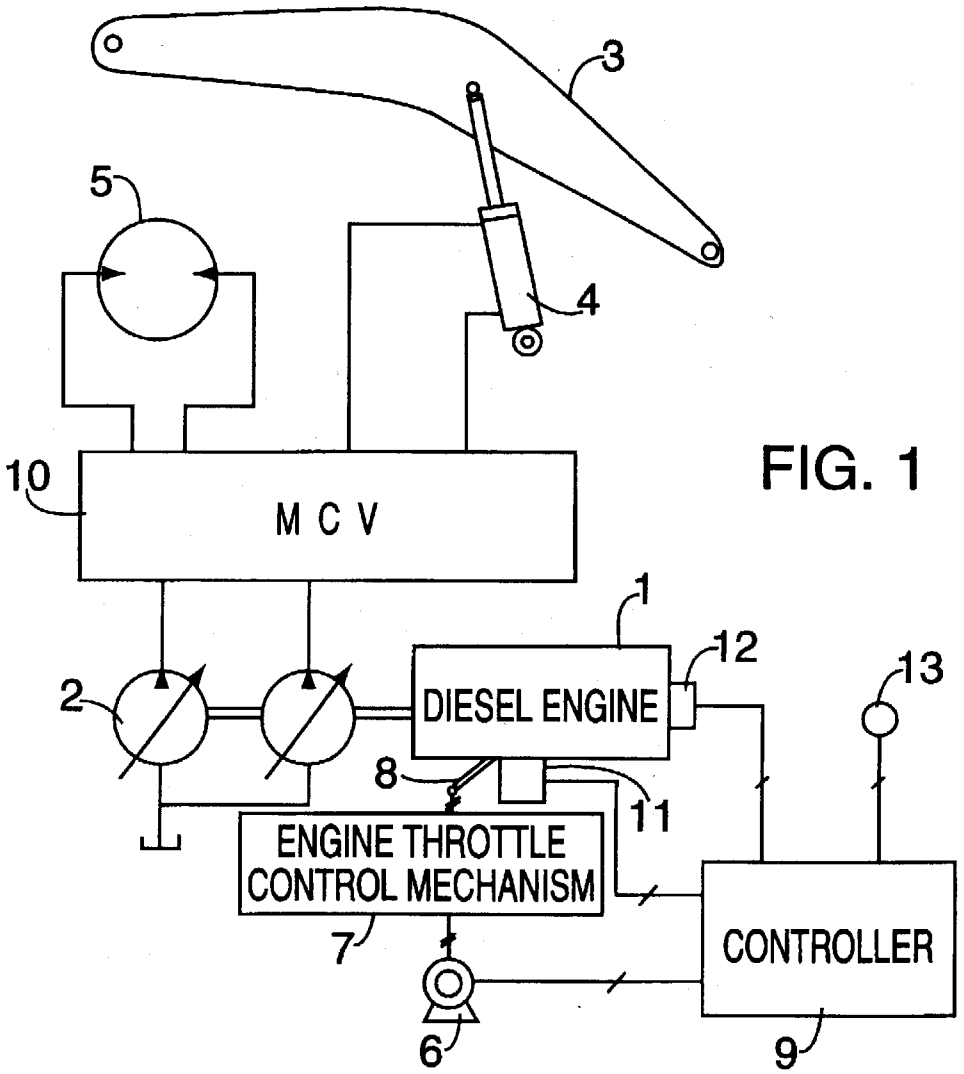
FIG. 1 is a schematic view illustrating the construction of a conventional engine-pump system for a hydraulic construction machine.
Figure 2:
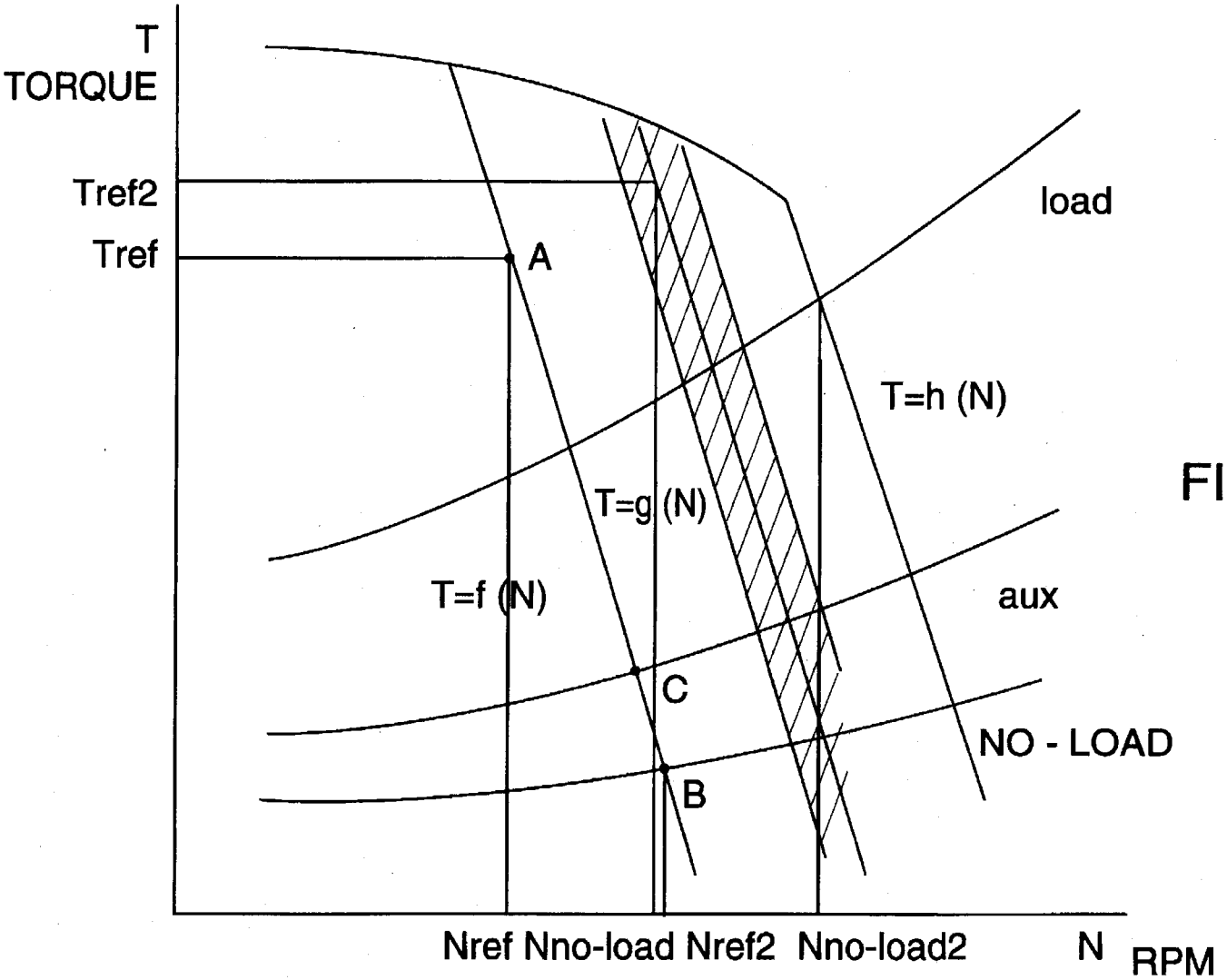
FIG. 2 is a view illustrating the relation between the RPM and output characteristic of an engine in FIG. 1 with respect to a load.
Figure 3:
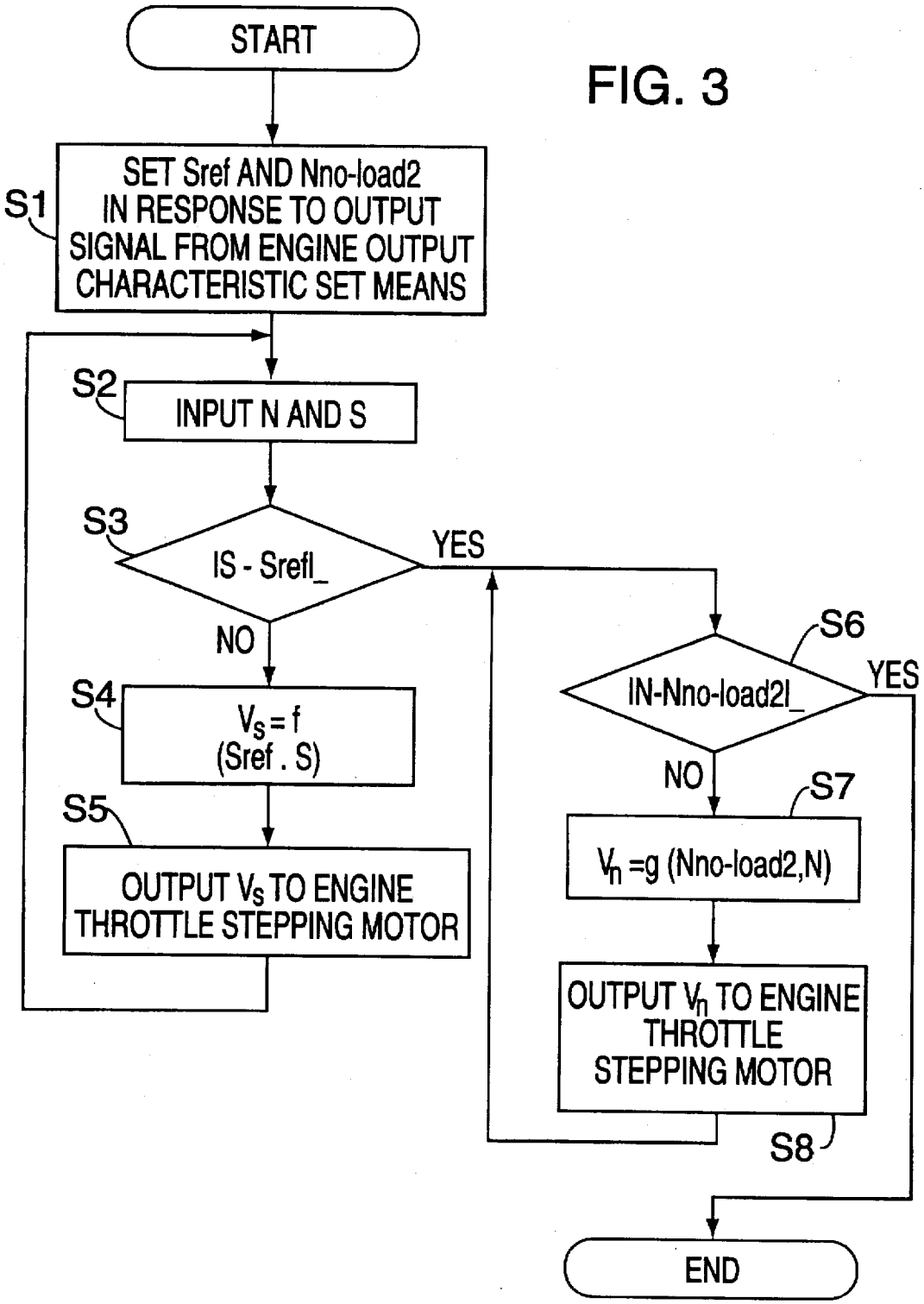
FIG. 3 is a flowchart illustrating a method for controlling the RPM of an engine in a hydraulic construction machine in accordance with an embodiment of the present invention.

FIG. 3 is a flowchart illustrating a method for controlling the RPM of an engine in a hydraulic construction machine in accordance with an embodiment of the present invention. In accordance with the preferred embodiment of the present invention, the construction to which the engine RPM control method is applied is the same as that of FIG. 1 and a detailed description thereof will thus be omitted. The engine RPM control method is performed according to a control program contained in the controller 9 in FIG. 1 and will hereinafter be described in detail with reference to FIGS. 2 and 3.

First, the controller 9 sets a reference throttle lever position value Sref and a reference no-load engine RPM value Nno–load2 in response to an output signal from the engine output characteristic set means 13 to allow the engine 1 to have a target output characteristic T=g(N). Then, the controller 9 performs a control arithmetic operation in response to a present throttle lever position value S from the engine throttle lever position detection means 11 and the set reference throttle lever position value Sref to allow a difference between the present throttle lever position value S and the set reference throttle lever position value Sref to be within the range of a mechanical error $\epsilon$ of the engine throttle control mechanism 7. As a result of the control arithmetic operation, the controller 9 generates a control signal Vs and outputs the generated control signal Vs to the engine throttle stepping motor 6 to control the engine throttle lever 8. Upon completing the above engine throttle lever position reference control operation, the controller 9 performs a control arithmetic operation in response to a present engine RPM value N from the engine RPM detection means 12 and the set reference no-load engine RPM value Nno–load2 to allow the present engine RPM value N to be approximated to the set reference no-load engine RPM value Nno–load2 under the condition that a difference therebetween is within the range of the mechanical error $\epsilon$ of the engine throttle control mechanism 7. As a result of the control arithmetic operation, the controller 9 generates a control signal Vn and outputs the generated control signal Vn to the engine throttle stepping motor 6 to control the engine throttle lever 8.

The above-mentioned engine RPM control method of the present invention will hereinafter be described in more detail with reference to FIG. 3.

First, assume that the present engine output characteristic is T=f(N) and the target engine output characteristic is T=g(N). At step S1, the controller 9 sets the reference throttle lever position value Sref and the reference no-load engine RPM value Nno–load2 in response to the output signal from the engine output characteristic set means 13 to allow the engine 1 to have the target output characteristic T=g(N).

Then, the controller 9 receives the present throttle lever position value S from the engine throttle lever position detection means 11 and the present engine RPM value N from the engine RPM detection means 12 at step S2.

At step S3, the controller 9 calculates the difference |S–Sref| between the present throttle lever position value S and the set reference throttle lever position value Sref and checks whether the calculated difference |S–Sref| is smaller than or equal to the mechanical error ϵ of the engine throttle control mechanism 7. If it is checked at the above step S3 that the calculated difference |S–Sref| is smaller than or equal to the mechanical error ϵ of the engine throttle control mechanism 7, the controller 9 proceeds to step S6. To the contrary, in the case where it is checked at the above step S3 that the calculated difference |S–Sref| is greater than the mechanical error ϵ of the engine throttle control mechanism 7, the controller 9 proceeds to step S4.

At step S4, the controller 9 performs the control arithmetic operation [Vs=f(Sref,S)] on the basis of two parameters, or the present throttle lever position value S and the set reference throttle lever position value Sref, to allow the calculated difference |S–Sref| to be smaller than or equal to the mechanical error ϵ of the engine throttle control mechanism 7.

At step S5, the controller 9 generates the control signal Vs as a result of the control arithmetic operation and outputs the generated control signal Vs to the engine throttle stepping motor 6 to control the engine throttle lever 8. Then, the controller 9 returns to the above step S2 to form an endless loop.

On the other hand, at step S6, the controller 9 calculates the difference |N–Nno–load2| between the present engine RPM value N and the set reference no-load engine RPM value Nno–load2 and checks whether the calculated difference |N–Nno–load2| is smaller than or equal to the mechanical error ϵ of the engine throttle control mechanism 7. If it is checked at the above step S6 that the calculated difference |N–Nno–load2| is smaller than or equal to the mechanical error ϵ of the engine throttle control mechanism 7, the controller 9 proceeds to step S9. To the contrary, in the case where it is checked at the above step S6 that the calculated difference |N–Nno–load2| is greater than the mechanical error ϵ of the engine throttle control mechanism 7, the controller 9 proceeds to step S7.

At step S7, the controller 9 performs the control arithmetic operation [Vn=g(Nno–load2,N)] on the basis of two parameters, or the present engine RPM value N and the set reference no-load engine RPM value Nno–load2, to allow the calculated difference |N–Nno–load2| to be smaller than or equal to the mechanical error ϵ of the engine throttle control mechanism 7.

At step S8, the controller 9 generates the control signal Vn as a result of the control arithmetic operation and outputs the generated control signal Vn to the engine throttle stepping motor 6 to control the engine throttle lever 8. Then, the controller 9 returns to the above step S6 to form an endless loop.

At step S9, the controller 9 ends the control operation because both the differences |S–Sref| and |N–Nno–load2| are smaller than or equal to the mechanical error ϵ the engine throttle control mechanism 7.

As apparent from the above description, in accordance with the present invention, the output characteristic of the engine is controlled according to working environment and characteristic in such a manner that it can be set to the optimum status with no effect of the disturbance load and the mechanical error of the throttle control mechanism when the RPM of the engine is set to the desired value. Therefore, the controlled engine output characteristic is not varied according to the disturbance load and the mechanical error of the throttle control mechanism, resulting in a significant increase in working performance.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A method for controlling the RPM of an engine in a hydraulic construction machine comprising the engine, means for setting an output characteristic of said engine, a motor for driving a throttle lever for said engine, an engine throttle control mechanism for transferring a drive force from said motor to said engine throttle lever, means for detecting a position of said engine throttle lever and control means for controlling RPM of said engine, said method comprising the steps of:

(a) setting a reference throttle lever position value in response to an output signal from said engine output characteristic set means to allow said engine to have a target output characteristic;

(b) performing a control arithmetic operation in response to a present throttle lever position value from said engine throttle lever position detection means and the set reference throttle lever position value to allow a difference between the present throttle lever position value and the set reference throttle lever position value to be within the range of a mechanical error of said engine throttle control mechanism; and (c) generating a control signal as a result of the control arithmetic operation and outputting the generated control signal to said motor to control the RPM of said engine.

2. In a hydraulic construction machine comprising an engine, means for setting an output characteristic of said engine, a motor for driving a throttle lever for said engine, an engine throttle control mechanism for transferring a drive force from said motor to said engine throttle lever, means for detecting RPM of said engine and control means for controlling the RPM of said engine, a method for controlling the RPM of said engine, comprising the steps of:

(a) setting a reference engine RPM value in response to an output signal from said engine output characteristic set means to allow said engine to have a target output characteristic;

(b) performing a control arithmetic operation in response to a present engine RPM value from said engine RPM detection means and the set reference engine RPM value to allow the present engine RPM value to be approximated to the set reference engine RPM value under the condition that a difference therebetween is within the range of a mechanical error of said engine throttle control mechanism; and (c) generating a control signal as a result of the control arithmetic operation and outputting the generated control signal to said motor to control the RPM of said engine.

3. In a hydraulic construction machine comprising an engine, means for setting an output characteristic of said engine, a motor for driving a throttle lever for said engine, an engine throttle control mechanism for transferring a drive force from said motor to said engine throttle lever, means for detecting a position of said engine throttle lever, means for detecting RPM of said engine and control means for controlling the RPM of said engine, a method for controlling the RPM of said engine, comprising the steps of:

(a) setting a reference throttle lever position value in response to an output signal from said engine output characteristic set means to allow said engine to have a target output characteristic;

(b) performing a first control arithmetic operation in response to a present throttle lever position value from said engine throttle lever position detection means and the set reference throttle lever position value to allow a difference between the present throttle lever position value and the set reference throttle lever position value to be within the range of a mechanical error of said engine throttle control mechanism;

(c) generating a first control signal as a result of the first control arithmetic operation and outputting the generated first control signal to said motor to control the RPM of said engine;

(d) setting a reference engine RPM value in response to the output signal from said engine output characteristic set means when the difference between the present throttle lever position value and the set reference throttle lever position value is within the range of the mechanical error of said engine throttle control mechanism;

(e) performing a second control arithmetic operation in response to a present engine RPM value from said engine RPM detection means and the set reference engine RPM value to allow the present engine RPM value to be approximated to the set reference engine RPM value under the condition that a difference therebetween is within the range of the mechanical error of said engine throttle control mechanism; and (f) generating a second control signal as a result of the second control arithmetic operation and outputting the generated second control signal to said motor to control the RPM of said engine.

* * * * *